United States Patent [19]

Drandell

[11] Patent Number: 4,862,597

[45] Date of Patent: Sep. 5, 1989

[54] VARIABLE STENCIL

[76] Inventor: Marvin L. Drandell, P.O. Box 24242, Los Angeles, Calif. 90024

[21] Appl. No.: 195,861

[22] Filed: May 19, 1988

[51] Int. Cl.[4] ..... B43L 13/02

[52] U.S. Cl. ..... 33/565

[58] Field of Search ..... 33/562, 563, 564, 565, 33/566; 101/127, 128.21, 129

[56] References Cited

U.S. PATENT DOCUMENTS

| | | | |
|---|---|---|---|
| 2,702,944 | 3/1955 | Lane et al. | 33/563 X |
| 2,909,843 | 10/1959 | Bechtel | 33/564 |
| 3,483,628 | 12/1969 | Newman | 33/565 |

FOREIGN PATENT DOCUMENTS

| | | | |
|---|---|---|---|
| 1193082 | 4/1959 | France | 33/DIG. 9 |

OTHER PUBLICATIONS

Popular Mechanics: Shop Notes, vol. 41, 1944 "Twin Templates" by Sprague.

*Primary Examiner*—Harry N. Haroian
*Attorney, Agent, or Firm*—Harry W. Brelsford

[57] ABSTRACT

A stencil is constructed from a stationary envelope and an insert sheet disposed in the envelope but free to be moved with respect to the envelope. The subject matter to be stencilled is cut through the envelope and through the insert sheet. The cuts create openings in the envelope, and when the openings are registered the full subject matter is stencilled. Artistic effects are obtained by moving the sheet slightly out of registry with the envelope and then stencilling.

3 Claims, 2 Drawing Sheets

VARIABLE STENCIL

This invention relates to a stencil that can produce different stencil marking from the same structure and has particular reference to a multi piece stencil.

BACKGROUND OF THE INVENTION

Stencils are generally of two types, either one piece or multi piece. The one piece stencils have the entire pattern, for example a person's name, cut into a single sheet or piece of impervious material. The multi piece stencils have separate parts that are either together in a frame or taped on a sheet of impervious material having a cut out for the stencil opening. For example, letters of the alphabet may be cut out of cards of the same size with one card for each letter and taped or otherwise held together to spell out a person's name. Paint or ink is sprayed or painted through the stencil opening to produce the person's name or other desired pattern.

With either type it is difficult to achieve artistic results by moving the stencils. Both types of stencils may give a shadow effect by moving it slightly and spraying a different color ink or paint. However, the stenciled material is merely enlarged without changing the artistic effect.

BRIEF SUMMARY OF THE INVENTION

I have discovered a two piece stencil that can be manipulated to achieve artistic subject matter. I use an envelope of impervious material through both sides of which are cut apertures that form the subject matter pattern, whether letters, numbers, other symbol's or artistic patterns. I dispose inside the envelope a sheet of impervious material having apertures formed therein that are identical in shape and size to the envelope apertures. The pattern cut into the sheet is so located on the sheet that the sheet apertures can be registered with the envelope apertures to form a "see through" assembly. Paint or ink is now applied through the registered apertures of the envelope and enclosure sheet to form the principal pattern.

An artistic variation of this principal pattern is created by manually moving the enclosure sheet relative to the envelope to expose only part of the principal pattern. This new pattern can now be used on top of the original stenciled subject matter by using a different color ink or paint. Alternatively the assembly of envelope and insert sheet can be moved to a new location to create a fresh image.

DETAILED DESCRIPTION

Figure 1:
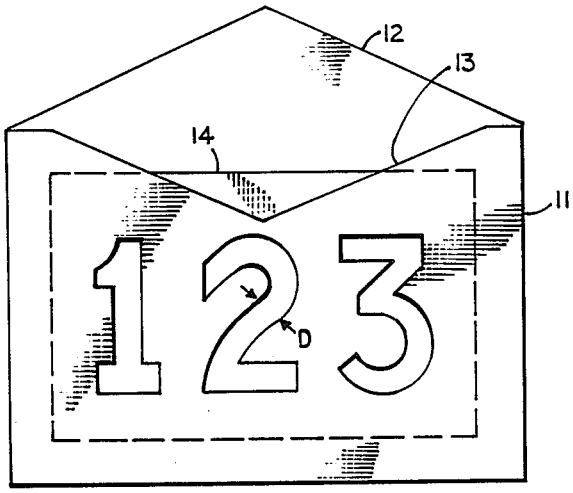
FIG. 1 is an elevation view of a stencil including an envelope and insert sheet, both having identical numerals cut entirely through the envelope and insert, wherein the numerals are registered for a "see through" assembly.

Referring to FIG. 1 an envelope 11 has a flap 12 and an envelope opening 13 as is usual with envelopes. The envelope 11 has a front and back and cut through both the front and back of the envelope 11 are the numerals 1,2, and 3 each having a parallel sides with a generally uniform dimension D between parallel sides. Disposed within the envelope 11 is a sheet or insert 14 having cut therein the same numerals 1,2, and 3 of the same size and dimensions as the numerals 1,2, and 3 in the envelope. It will be noted that the insert or sheet 14 is of smaller height and width than the envelope 11 so that the insert 14 may be manually moved to desired position within the envelope. This manipulation can be effected by the stenciler inserting his fingers through the opening 13 to grasp the insert. As shown in FIG. 1, the numerals 1,2, and 3 of the insert are in registry with the numerals 1,2, and 3 of the envelope and when ink or paint is sprayed or painted through the numerals the stenciled subject matter will have the same shape and size and uniform dimension D as shown in FIG. 1.

Figure 2:
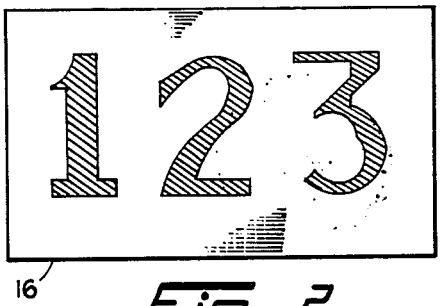
FIG. 2 shows the numerals of FIG. 1 stenciled on to a sign board wherein the insert sheet of FIG. 1 has been moved downwardly within the envelope before stenciling.

If now the operator inserts his fingers or tweezers inside of the envelope 11 to grasp the insert 14, and move it downwardly numerals are out of exact registry and the result is shown in the stenciled sign 16 of FIG. 2. There it will be noted that the vertical portions of the letters 1,2, and 3 retain substantially their dimension D but the horizontal parts of the letter are thinned. Even more downward movement will result in the horizontal portions of the stenciled subject matter disappearing entirely for even a more artistic effect.

Figure 3:
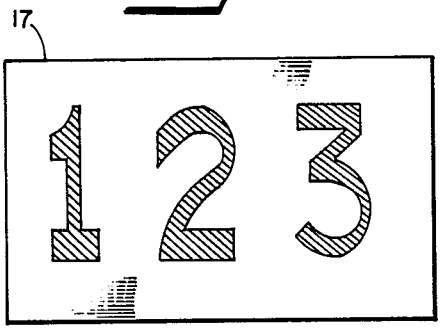
FIG. 3 shows the numerals of FIG. 1 stenciled on to a sign board wherein the insert sheet has been moved to the right within the envelope as viewed in FIG. 1 before stenciling.

Referring now to FIGS. 1 and 3 if the operator moves the insert 14 to the right instead of downwardly, then the result is shown on the sign board 17 of FIG. 3. There it will be noted that the horizontal portions of the numerals 1,2 and 3 have retained their dimension D but the vertical portions have been thinned.

Results similar to FIG. 2 can be obtained in FIG. 2 by upward movement of the insert 14 and results similar to FIG. 3 can be obtained by moving the insert 14 to the left as viewed in FIG. 1.

Figure 4:
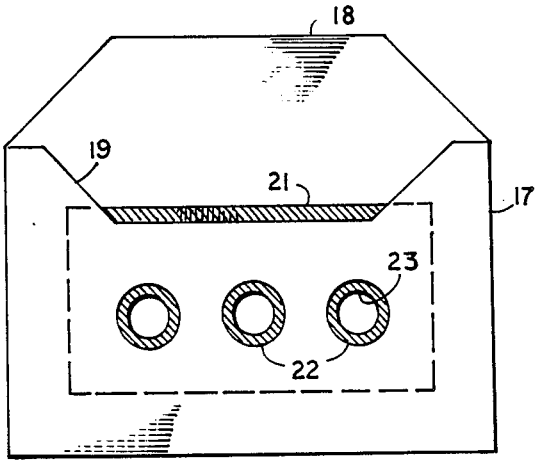
FIG. 4 is an elevation view of a modified form of a stencil having three holes as the stencil subject matter wherein the holes in the envelope are larger than the hole in the insert, and the insert is of a different color than the envelope.

Referring now to FIG. 4 there is illustrated an envelope 17 having a flap 18 and opening 19 through which has been inserted a sheet 21 of different color than the envelope 17. Cut through the front and back of envelope 17 is a pattern in the form of three large holes 22, and cut through the insert 21 are smaller holes 23 of the same spacing as the holes 22. The difference in color of the insert is shown by cross hatching the area between the two holes. This difference in color is useful when a sign board of the same general color as the envelope and the stencil subject matter has to be carefully registered on the sign board.

Figure 4A:
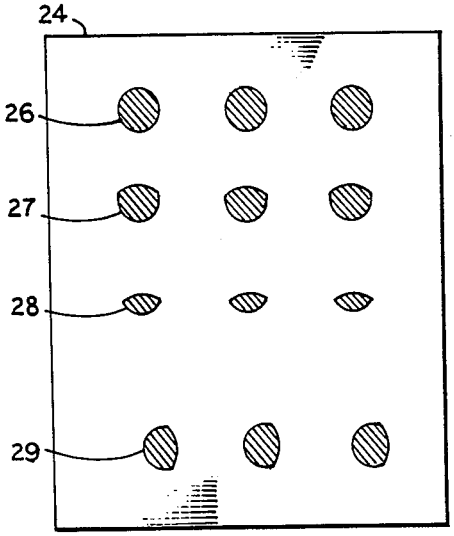
FIG. 4A is an elevation view of a sign board showing different stenciled patterns obtained by moving the insert sheet of FIG. 4 within the envelope.

Referring to FIG. 4a there is illustrated a sign board 24 upon which has been stenciled the pattern of the stencil if FIG. 4 when insert 21 is moved within the envelope 17. The circles 26 are stenciled when the insert envelope relation is that shown in FIG. 4. Truncated circles 27 result when insert is moved upwardly. Ellipses 28 are stenciled when the insert 17 even more upwardly. When the insert 21 is moved to the right, this results in stenciled subject matter 29 wherein the circles are truncated on their right sides.

Figure 5:
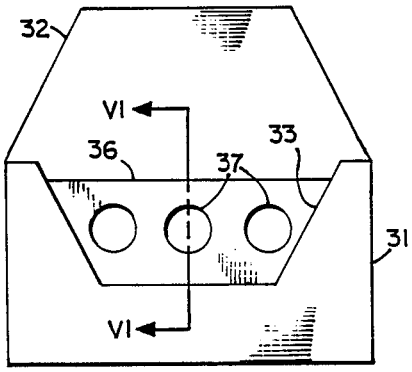
FIG. 5 is an elevation view of a modified form of my stencil wherein the apertures in the envelope are in a cut out portion of the back of the envelope.
Figure 6:
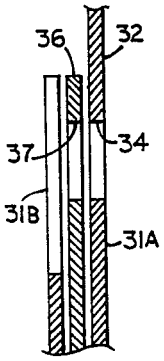
FIG. 6 is a cross sectional view on an enlarged scale along the line VI—VI of FIG. 5.

Referring to FIGS. 5 and 6 there is illustrated an envelope 31 having a flap 32 and a V shaped opening 33. Formed in the front side 31 A of the envelope 31 is an aperture 34. Disposed in the envelope 31 is an insert sheet 36 having an aperture 37 cut therein and, as shown in FIG. 6, the aperture 37 is registered with the envelope aperture 34. The back side 31B of the envelope 31 is missing in the area of holes 34 and 37 and the stenciled in case consists of only one set of envelope holes and one set of insert holes.

Figure 7:
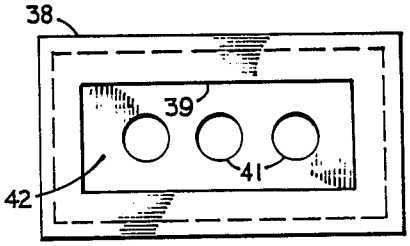
FIG. 7 is an elevation view of a modified form of the invention wherein a substantial portion of the back of the envelope is cut out and the envelope and insert apertures occur in this cut out area.

Referring to FIG. 7 there is illustrated on envelope 38 having a full front and back cut out in a rectangle to define an opening 39. Formed on the front of the envelope are apertures in the pattern of three circles 41. Inserted in the envelope 38 is a sheet 42 having apertures of the same size and location as the apertures 41. This is a modification of FIG. 5 wherein the cut out 39 is larger than in FIG. 5 but the aperture relationship is the same. In FIG. 7 the envelope back acts as guides for the movement of the insert sheet 42.

Figure 8:
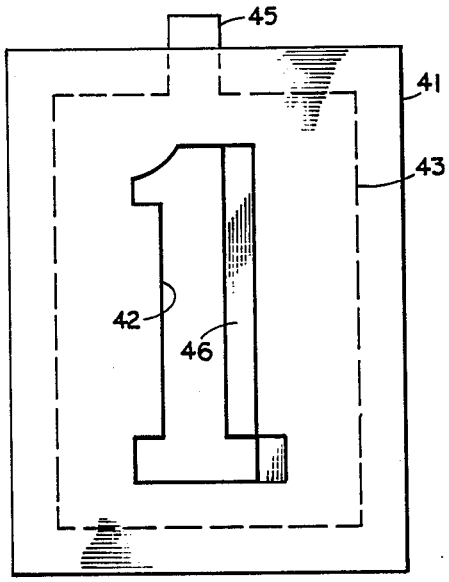
FIG. 8 is an elevation view of an envelope and insert both having the same pattern but with the insert moved to the left.
Figure 9:
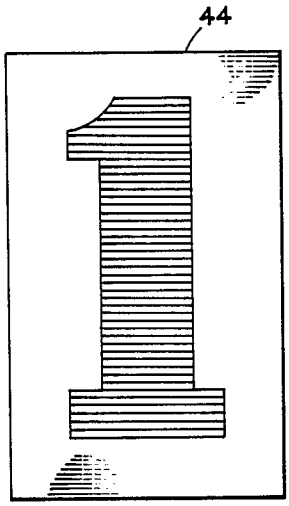
FIG. 9 is an elevation view of a sign board with the stenciled numeral 1 made when the insert and envelope of FIG. 8 are in registry.
Figure 10:
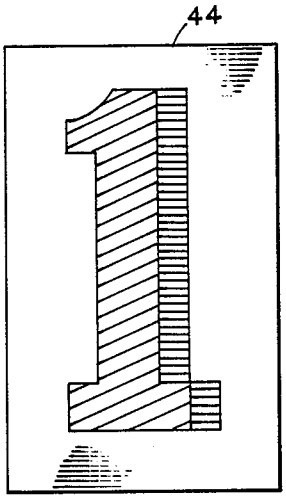
FIG. 10 is an elevation view of the image on the sign board of FIG. 9 over painted by moving the insert to the left as viewed in FIG. 8.

Referring to FIGS. 8, 9 and 10 there is illustrated the use of my stencil to produce a shadow effect on the numeral 1. An envelope 41 with an aperture 42 in the shape of numeral 1 has an insert sheet 43 disposed therein also having an aperture in the shape and size of the numeral 1 of the envelope. A tab 45 is attached to the insert 43 and projects through the open top of envelope 41 for manipulation of the insert 43. A stencil numeral 1 on a sign board 44 of FIG. 9 is made with the two apertures registered. The color of the image as shown by horizontal lines in FIG. 9. The operator next holds the envelope 41 on the same place on the sign board 44 but moves the insert 43 to the left and the right edge of the insert aperture is the line 46. This movement of the insert 43 covers up a strip of the right part of the stenciled image in FIG. 9. If now a different color ink or paint is applied, the part of the numeral 1 not covered will be a different color as shown by the diagonal cross hatch lines in FIG. 10. By careful selection of the two colors a shadow effect is achieved.

Figure 11:
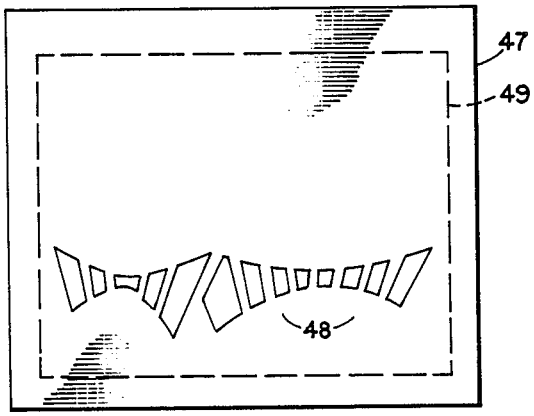
FIG. 11 is an elevation view of an envelope and insert having a fanciful design in both the envelope and the insert and in registry.

Illustrated in FIG. 11 is an envelope 47 having apertures in the front and back in the shape of a fanciful design 48. An insert sheet 49 also has identical pattern of apertures and has lesser dimensions than the envelope 47 so that it can be moved within the envelope to cover up selected portions of the pattern.

Figure 12:
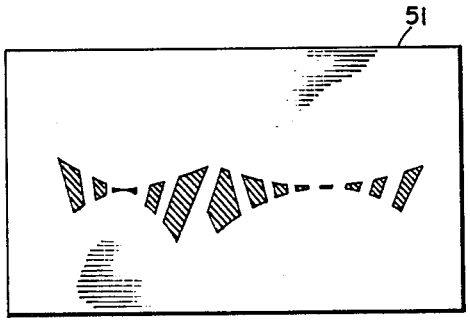
FIG. 12 is an elevation view of a stenciled sign board showing variations of the patter of FIG. 11 when the insert sheet is moved in upwardly within the envelope.

Shown in FIG. 12 is a sign board 51 on which has been stenciled the modification of design 48 when the insert is moved upwardly within the envelope.

Figure 13:
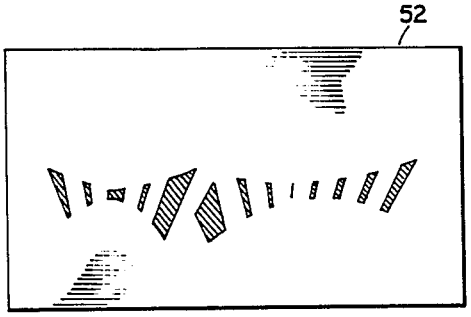
FIG. 13 is an elevation view of a stenciled sign board showing the design of FIG. 11 when the insert is moved to the right.

Shown in FIG. 13 is a sign board 52 on which has been stenciled the modification of design 48 when the insert is moved to the right within the envelope.

It will be obvious to those skilled in the art that the pattern of the insert need not be identical to design in the envelope to achieve my artistic effects. If the insert design is similar to that of the envelope, the artistic effects will be achieved. While it is difficult to quantify similarity to the designs that is effective, the difference in size or shape or mutilation of the insert design should be limited to the 20% to 25% range. Various types of inserts such as tooth combs, diagonal strips can be used but they are not effective in achieving effects that I consider to be desirable.

Also two or more similar designs could be placed on a frame or guides that permits relative movement of two stencils up or down or sideways. I prefer however to use envelopes as the guides as this combination is much easier to manipulate, especially when the envelope is pinched between fingers to hold the insert in a selected position.

I have described my invention with respect to presently preferred embodiments as required by the patents statutes. It will be apparent to those skilled in the art that various modifications may be made therein. I include within the scope of the following claims all modifications and variations that fall within the true spirit and scope of the invention.

I claim:

1. A variable stencil comprising:

(a) an envelope having a front and a back and open at one end and having at least one aperture through both the front and back, said apertures being generally aligned to provide a see through window in the envelope;

(b) an insert disposed in the envelope and having at least one aperture, said insert being moveable within the envelope to align the insert aperture with the envelope apertures to expose all of the envelope apertures or a portion thereof.

2. A variable stencil comprising:

(a) an envelope having a front and back and open at one end and having a plurality of aligned apertures through the front and the back that form a pattern;

(b) and a sheet in the envelope having a plurality of apertures in a pattern similar to the envelope pattern, said sheet being moveable within the envelope apertures and moveable to expose all or a selected portion of the envelope apertures.

3. A variable stencil as a set forth in claim 2 wherein the sheet is of smaller dimension than the envelope to obtain sheet movement in any direction with respect to the envelope.

* * * * *